US010180089B2

(12) United States Patent
Liskar et al.

(10) Patent No.: US 10,180,089 B2
(45) Date of Patent: Jan. 15, 2019

(54) VALVETRAIN WITH ROCKER ARM HOUSING MAGNETICALLY ACTUATED LATCH

(71) Applicant: Eaton Corporation, Cleveland, OH (US)

(72) Inventors: Petr Liskar, Prague (CZ); Mark Allan Juds, New Berlin, WI (US); Mustafa Huseyin, London (GB); Peter John Theisen, West Bend, WI (US); Amogh Vilas Kank, Thane (IN); Dale Arden Stretch, Novi, MI (US); Andrei Dan Radulescu, Marshall, MI (US); Douglas Anthony Hughes, Novi, MI (US); Otto Schultheis, Albion, MI (US); Kyle Crayne, Bloomfield Hills, MI (US); James Edward McCarthy, Jr., Canton, MI (US)

(73) Assignee: Eaton Intelligent Power Limited, Dublin (IE)

( * ) Notice: Subject to any disclaimer, the term of this patent is extended or adjusted under 35 U.S.C. 154(b) by 165 days.

(21) Appl. No.: 15/503,458

(22) PCT Filed: Aug. 18, 2015

(86) PCT No.: PCT/US2015/045759
§ 371 (c)(1),
(2) Date: Feb. 13, 2017

(87) PCT Pub. No.: WO2016/028812
PCT Pub. Date: Feb. 25, 2016

(65) Prior Publication Data

US 2017/0241300 A1 Aug. 24, 2017

Related U.S. Application Data

(63) Continuation-in-part of application No. PCT/US2015/043069, filed on Jul. 31, 2015.
(Continued)

(30) Foreign Application Priority Data

Aug. 18, 2014 (IN) ..... 2335/DEL/2014

(51) Int. Cl.
*F01L 1/18* (2006.01)
*F01L 13/00* (2006.01)
(Continued)

(52) U.S. Cl.
CPC ..... *F01L 13/0005* (2013.01); *F01L 1/185* (2013.01); *F01L 1/2405* (2013.01); *F01L 1/46* (2013.01);
(Continued)

(58) Field of Classification Search
CPC ..... F01L 1/185; F01L 2001/186; F01L 2001/187; F01L 1/2405; F01L 1/46;
(Continued)

(56) References Cited

U.S. PATENT DOCUMENTS 4,203,397 A * 5/1980 Soeters, Jr. ..... F01L 1/2405 123/198 F
4,762,096 A * 8/1988 Kamm ..... F01L 13/0026 123/198 F
(Continued)

FOREIGN PATENT DOCUMENTS

EP 2050933 A1 * 4/2009 ..... F01L 1/185

*Primary Examiner* — Jorge Leon, Jr.
(74) *Attorney, Agent, or Firm* — Paul V. Keller

(57) ABSTRACT

A valvetrain includes a rocker arm assembly having an electromagnetic latch housed in a chamber formed by a rocker arm. The chamber may be a retrofit hydraulic cham-
(Continued)

ber. A flux shifting bi-stable latch provides a sufficiently compact design. Isolation of the magnetic elements within the rocker arm chamber may provide protection from metal particles carried by oil in an operating environment for the rocker arm assembly. Wiring connections to the rocker arms may be made through spring posts on the rocker arms. Connection to the rocker arms may be made with springs that can endure the rapid motion induced by the rocker arms. A wiring harness for the rocker arms may attach to hydraulic lash adjusters of the rocker arm assemblies. The rocker arm assemblies and their wiring may be formed into a unitary module that facilitates installation.

20 Claims, 12 Drawing Sheets

Related U.S. Application Data

(60) Provisional application No. 62/190,460, filed on Jul. 9, 2015, provisional application No. 62/140,096, filed on Mar. 30, 2015, provisional application No. 62/155,069, filed on Apr. 30, 2015, provisional application No. 62/195,766, filed on Jul. 22, 2015.

(51) Int. Cl.
*F01L 1/24* (2006.01)
*F01L 9/04* (2006.01)
*F01L 1/46* (2006.01)

(52) U.S. Cl.
CPC ..... *F01L 13/0036* (2013.01); *F01L 2001/186* (2013.01); *F01L 2001/187* (2013.01); *F01L 2009/0401* (2013.01); *F01L 2009/0421* (2013.01); *F01L 2009/0428* (2013.01); *F01L 2009/0448* (2013.01); *F01L 2009/0463* (2013.01); *F01L 2009/0465* (2013.01); *F01L 2103/00* (2013.01); *F01L 2105/00* (2013.01); *F01L 2820/031* (2013.01)

(58) Field of Classification Search
CPC ..... F01L 2009/0401; F01L 2009/0421; F01L 2009/0428; F01L 2009/0448; F01L 2009/0463; F01L 2009/0465; F01L 13/0005; F01L 2820/031
USPC ..... 123/90.41, 90.43, 90.44, 90.46
See application file for complete search history.

(56) References Cited

U.S. PATENT DOCUMENTS

| | | | | |
|---|---|---|---|---|
| 5,544,626 | A | 8/1996 | Diggs et al. | |
| 5,623,897 | A * | 4/1997 | Hampton | F01L 1/185 123/198 F |
| 6,318,318 | B1 | 11/2001 | Jahr | |
| 2001/0039930 | A1* | 11/2001 | Nakashima | F01L 13/0005 123/90.16 |
| 2002/0124820 | A1* | 9/2002 | Kreuter | F01L 13/0005 123/90.16 |
| 2003/0111031 | A1* | 6/2003 | Hendricksma | F01L 1/18 123/90.15 |
| 2008/0006232 | A1* | 1/2008 | Gregor | F01L 1/185 123/90.15 |

* cited by examiner

VALVETRAIN WITH ROCKER ARM HOUSING MAGNETICALLY ACTUATED LATCH

FIELD

The present teachings relate to valvetrains, particularly valvetrains providing variable valve lift (VVL) or cylinder deactivation (CDA).

BACKGROUND

Hydraulically actuated latches are used on some rocker arm assemblies to implement variable valve lift (VVL) or cylinder deactivation (CDA). For example, some switching roller finger followers (SRFF) use hydraulically actuated latches. In these systems, pressurized oil from an oil pump may be used for latch actuation. The flow of pressurized oil may be regulated by an oil control valve (OCV) under the supervision of an engine control unit (ECU). A separate feed from the same source provides oil for hydraulic lash adjustment. In these systems each rocker arm assembly has two hydraulic feeds, which entails a degree of complexity and equipment cost. The oil demands of these hydraulic feeds may approach the limits of existing supply systems.

SUMMARY

The complexity and demands for oil in some valvetrain systems can be reduced by replacing hydraulically latched rocker arm assemblies with electrically latched rocker arm assemblies. Electric latches generate magnetic fields. These fields may magnetize ferromagnetic parts. In some cases, it may be desirable to use latch components that include permanent magnets. Rocker arm assemblies operate in an environment that contains engine oil in which small particles of metal may be suspended. Solenoids and magnetized parts may draw these particles to locations where they could interfere with latch pin operation.

The present teachings relate to an internal combustion engine, which may include a cylinder head, a poppet valve having a seat within the cylinder head, a cam shaft on which is mounted an eccentrically shaped cam, an electromagnetic latch assembly comprising a latch pin translatable between a first position and a second position, and a rocker arm assembly abutting the poppet valve. The rocker arm assembly may include a cam follower positioned to follow the cam and a rocker arm forming a chamber out of which the latch pin extends when the latch pin is in one of the first and second positions. One of the first and second latch pin positions may provide a configuration in which the rocker arm assembly is operative to actuate the valve in response to rotation of the cam shaft to produce a first valve lift profile. The other of the first and second latch pin positions may provide a configuration in which the rocker arm assembly is operative to actuate the valve in response to rotation of the cam shaft to produce a second valve lift profile, which is distinct from the first valve lift profile, or the valve is deactivated.

According to some aspects of the present teachings, a magnetic element forming part of the electromagnetic latch assembly is housed within a chamber formed by the rocker arm. In some of these teachings, the chamber is sealed against intrusion of metal particles that may be carried by oil in an environment surrounding the rocker arm. The magnetic element may remain within the chamber as the latch pin translates between the first position and the second position.

In some of these teachings, parts of the electromagnetic latch assembly including the magnetic element are rigidly mounted to the rocker arm. In some of these teaching, the magnetic element is a solenoid. In some of these teaching, the magnetic element is a permanent magnet.

Some of the present teachings relate to retrofitting a hydraulically latched rocker arm assembly with an electromagnetic latch. Rocker arms for commercial applications are typically manufactured using customized casting and stamping equipment requiring a large capital investment. According to the present teachings, a magnetic element forming part of the electromagnetic latch assembly is housed within a hydraulic chamber formed in a rocker arm. In some of these teachings, the magnetic element is rigidly mounted within the hydraulic chamber. The rocker arm may have been designed and put into production for use with a hydraulically actuated latch. In some of these teachings, a hydraulic passage with a terminus at the hydraulic chamber is formed in the rocker arm. It has been found that components of a hydraulic latch assembly, which may include a solenoid of sufficient size to actuate a rocker arm latch, can be retrofit into a rocker arm chamber that was designed for a hydraulically actuated latch. The chamber may be sealed to protect the magnetic element from metal particles suspended in oil, which may be dispersed in the environment surrounding the rocker arm.

According to some other aspects of the present teachings, the solenoid or a permanent magnet forming part of the electromagnetic latch assembly is rigidly mounted to the rocker arm and the electromagnetic latch assembly provides the latch pin with positional stability independently from the solenoid when the latch pin is in the first position and when the latch pin is in the second position. This dual positional stability enables the latch to retain both latched and unlatched states without reliance on the solenoid. The solenoid then does not need to be powered and need not be operative on the latch pin except for latch pin actuation, which may be limited to times at which the cam is on base circle. This can facilitate the implementation of an electromagnetic latch assembly a portion which is mounted on a rocker arm that moves rapidly at times over the course of its operating cycle. Installing a significant portion of an electromagnetic latch assembly, including at least the solenoid or a permanent magnet, on the rocker arm can provide a more compact design as compared to one in which an electromagnetic latch assembly is mounted off the rocker arm.

According to some aspects of the present teachings, a permanent magnet contributes to the positional stability of the latch pin both when the latch pin is in the first position and when the latch pin is in the second position. According to some further aspects of these teachings, the electromagnetic latch assembly is structured to operate through a magnetic circuit shifting mechanism. The electromagnetic latch assembly may provide two distinct magnetic circuits, one or the other of which is operative to be the primary path for magnet flux from the permanent magnet depending on the whether the latch pin is in the first position or the second position, absent magnetic fields from the solenoid or any external source that might alter the path taken by the magnetic flux. In some of these teachings, actuating the latch pin may involve using the solenoid to redirect the permanent magnet's flux from the one circuit to the other. An electromagnetic latch assembly structured to be operable through a magnetic circuit shifting mechanism may be smaller than one that is not so structured. In some of these teachings, the permanent magnet is fixedly mounted to the rocker arm. Fixing the permanent magnet to the rocker arm means not fixing the permanent magnet to the latch pin. Taking the weight of the permanent magnet off the latch pin may increase actuation speed and allow the use of a smaller solenoid.

In some of these teaching, the solenoid encircles a volume within which a portion of the latch pin comprising low coercivity ferromagnetic material translates and the electromagnetic latch assembly comprises one or more sections of low coercivity ferromagnetic material outside the volume encircled by the solenoid. Both the first and the second magnetic circuits pass through the latch pin portion formed of low coercivity ferromagnetic material. In some of these teachings, the first magnetic circuit passes around the solenoid's coils via the one or more sections of low coercivity ferromagnetic material while the second magnetic circuit does not pass around the solenoid's coils. This characteristic of the second magnetic circuit reduces magnetic flux leakage and increases the holding force per unit mass provided by the permanent magnet when the latch pin is in the second position.

In some of these teachings, the electromagnetic latch assembly includes a second permanent magnet distal from the first and fulfilling a complimentary role. The electromagnetic latch assembly may provide two distinct magnetic circuits for the second permanent magnet, one or the other of which is operative to be the primary path for magnet flux from the second permanent magnet depending on the whether the latch pin is in the first position or the second position. The path taken when the latch pin is in the second position may pass around the solenoid's coils via the one or more sections of low coercivity ferromagnetic material. The path taken when the latch pin is in the first position may be a shorter path that does not pass around the solenoid's coils. One or the other of the permanent magnets may then provide a high holding force depending on whether the latch pin is in the first or second positions. In some of these teachings, both permanent magnets contribute to the positional stability of the latch pin in both the first and the second latch pin positions. In some of these teachings, the two magnets are arranged with confronting polarities. In some of these teachings, the two magnets are located at distal ends of the volume encircled by the solenoid. In some of these teachings, the permanent magnets are annular in shape and polarized along the directions of the axes. These structures may be conducive to providing a compact and efficient design.

In some of the present teaching, the electromagnetic latch assembly includes at least one permanent magnet and the internal combustion engine has circuitry operable to energize the solenoid with a current in either a first direction or a second direction, which is the reverse of the first direction. A latch having dual positional stability may require the solenoid current to be in one direction for latching and the opposite direction for unlatching. The solenoid powered with current in the first direction may be operative to actuate the latch pin from the first position to the second position. The solenoid powered with current in the second direction may be operative to actuate the latch pin from the second position to the first position. In some others of these teachings, the electromagnetic latch assembly include two solenoids, one for latching and the other for unlatching. The two solenoids may have windings in opposite directions. Employing two solenoid may allow for the control circuitry to be more robust. Employing only one solenoid may provide the most compact design.

Some of the present teachings relate to powering or communicating with an electronic device such as a solenoid that is mounted to a rocker arm. If the electronic device is powered with conventional wiring, it is a possible for a wire to be caught, clipped, or fatigued and consequently short out. The present disclosure provides teachings that simplify or increase the reliability of these wiring connections.

According to some aspects of the present teachings, the rocker arm includes a spring post and an electrical connection for the electronic device enters the rocker arm through the spring post. A lost motion spring maybe mounted to the spring post. The spring post may have a narrow range of motion relative to the cylinder head as compared to distal locations on the rocker arm. In some of these teachings, the rocker arm has a valve end and a second end distal from the valve end and a slot entering the spring post is formed in one of the ends. Such a slot may facilitate installation of an electronic device with a wiring connection through the spring post.

According to some aspects of the present teachings, an electrical connection for an electronic device mounted to a rocker arm is formed with a spring extending toward the rocker arm. The spring may be electrically isolated from the cylinder head, which may be grounded. In some of these teachings, the current is carried by the spring itself. In some of these teachings, the current is carried by a wire trace formed on the spring. In some of these teachings, the current is carried by a wire bound along the length of the spring. The spring may stabilize the wiring connection. In some of these teachings, the spring has a natural frequency tuned to dampen its oscillations caused by motion of the rocker arm. In some of these teachings, the spring has a natural frequency greater than 500 Hz. A frequency above 500 Hz may be required for damping. In some of these teachings, the spring is formed from a coiled metal ribbon. In some of these teachings, the spring has the form of a spring clip.

According to some aspects of the present teachings, the rocker arm assembly includes a hydraulic lash adjuster and a wiring connection to the rocker arm is made from a wiring harness that is bound to the hydraulic lash adjuster. A wiring harness bound to the hydraulic lash adjuster may provide a good base from which to form an electrical connection to the rocker arm. In some of these teachings, the wiring harness is bound to a plurality of hydraulic lash adjusters and provides connections to rocker arms associated with each. The wiring harness bound to the hydraulic lash adjusters may facilitate installation of the valvetrain.

According to some aspects of the present teachings, there is provided a valve actuation module that includes a framework holding together a plurality of rocker arm assemblies each including at least one rocker arm with an electronic device mounted thereto and a hydraulic lash adjuster operative as a fulcrum for the rocker arm. The framework may support a wiring harness with connections to the electronic devices. In some of these teachings, the valve actuation module includes removable connectors between the rocker arms and the hydraulic lash adjusters. In some of these teachings, the removable connectors are breakaway connectors. The valve actuation module may be used to install a plurality of rocker arm assemblies and their wiring on a cylinder head simultaneously.

Some aspects of the present teachings relate to a method of manufacturing an internal combustion engine in which a rocker arm designed for use with a hydraulic latch is fit with an electromagnetic latch assembly. The rocker arm may have a hydraulic chamber and a hydraulic passage with a terminus at the hydraulic chamber. According to the method, a portion of the electromagnetic latch assembly is fit into the hydraulic chamber. In some of the teachings, a solenoid of the electromagnetic latch assembly is fit into the hydraulic chamber. In some of these teachings, a permanent magnet operative to stabilize a latch pin in both the first and second positions is fit into the hydraulic chamber.

Some aspects of the present teachings relate to a method of manufacturing an internal combustion engine in which a rocker arm has an electronic device mounted to it. According to the method, a slot is formed in one end of the rocker arm. The slot extends into a spring post of the rocker arm. The electronic device is installed in the rocker arm with a wiring connection emerging from the spring post through the slot.

Some aspects of the present teaching relate to a valve actuation module and use of that module in manufacturing an internal combustion engine having rocker arms to which electronic devices are mounted. According to the method, a valve actuation module that includes a plurality of rocker arm assemblies and a wiring harness making electrical connections to each of the electronic devices is installed in a cylinder head. In some of these teachings the valve actuation module includes a frame to which are bound a plurality of rocker arm assemblies. In some of these teachings, the frame is bound to hydraulic lash adjusters of the rocker arm assemblies. In some of these teachings, the wiring harness is bound to the frame. In some of these teachings, a rocker arm and a hydraulic lash adjuster are held together in the valve actuation module. In some of these teachings, a rocker arm and a hydraulic lash adjuster are held together in the valve actuation module by a connector that is readily removed or broken after installation of the valve actuation module in a cylinder head.

The primary purpose of this summary has been to present broad aspects of the present teachings in a simplified form to facilitate understanding of the present disclosure. This summary is not a comprehensive description of every aspect of the present teachings. Other aspects of the present teachings will be conveyed to one of ordinary skill in the art by the following detailed description together with the drawings.

DETAILED DESCRIPTION

Figure 1:
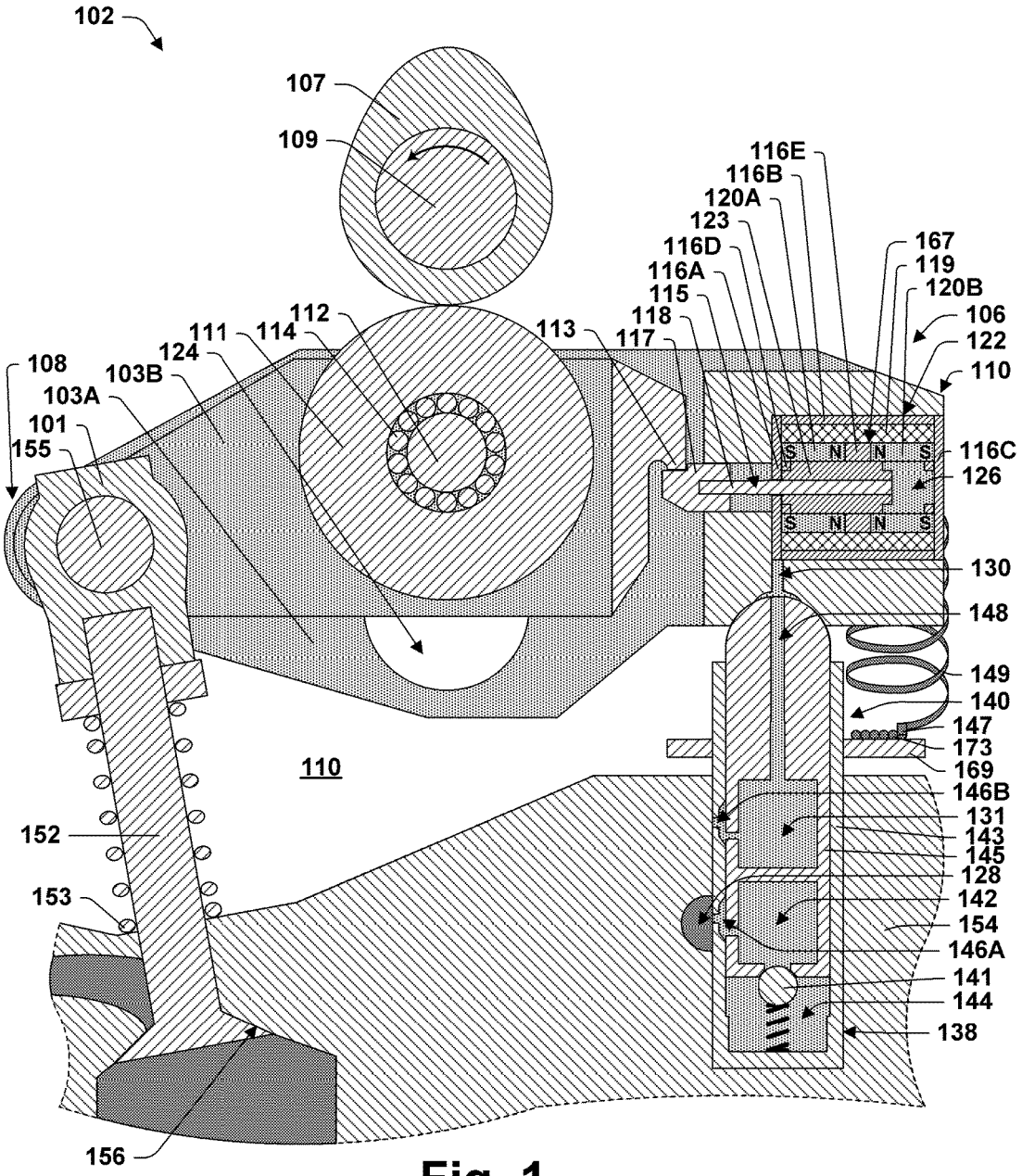
FIG. 1 is a cross-section side view of a portion of an internal combustion according to some aspects of the present teachings including a rocker arm assembly in a latching configuration and a cam on base circle.

In the drawings, some reference characters consist of a number with a letter suffix. In this description and the claims that follow, a reference character consisting of that same number without a letter suffix is equivalent to a listing of all reference characters used in the drawings and consisting of that same number with a letter suffix. For example, "rocker arm 103" is the same as "rocker arm 103A, 103B".

Figure 3:
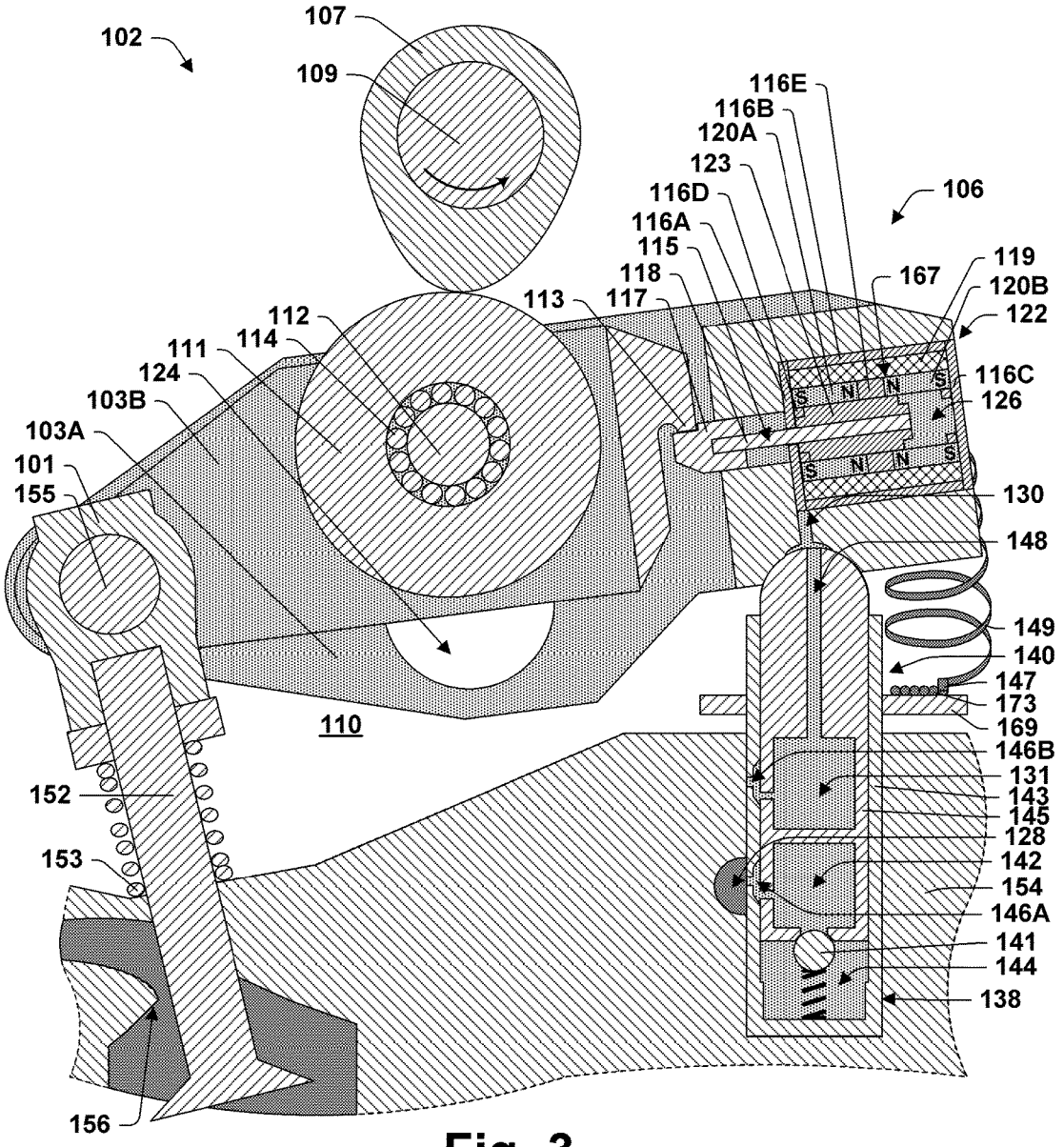
FIG. 3 provides the view of FIG. 1 but with the cam risen off base circle.
Figure 4:
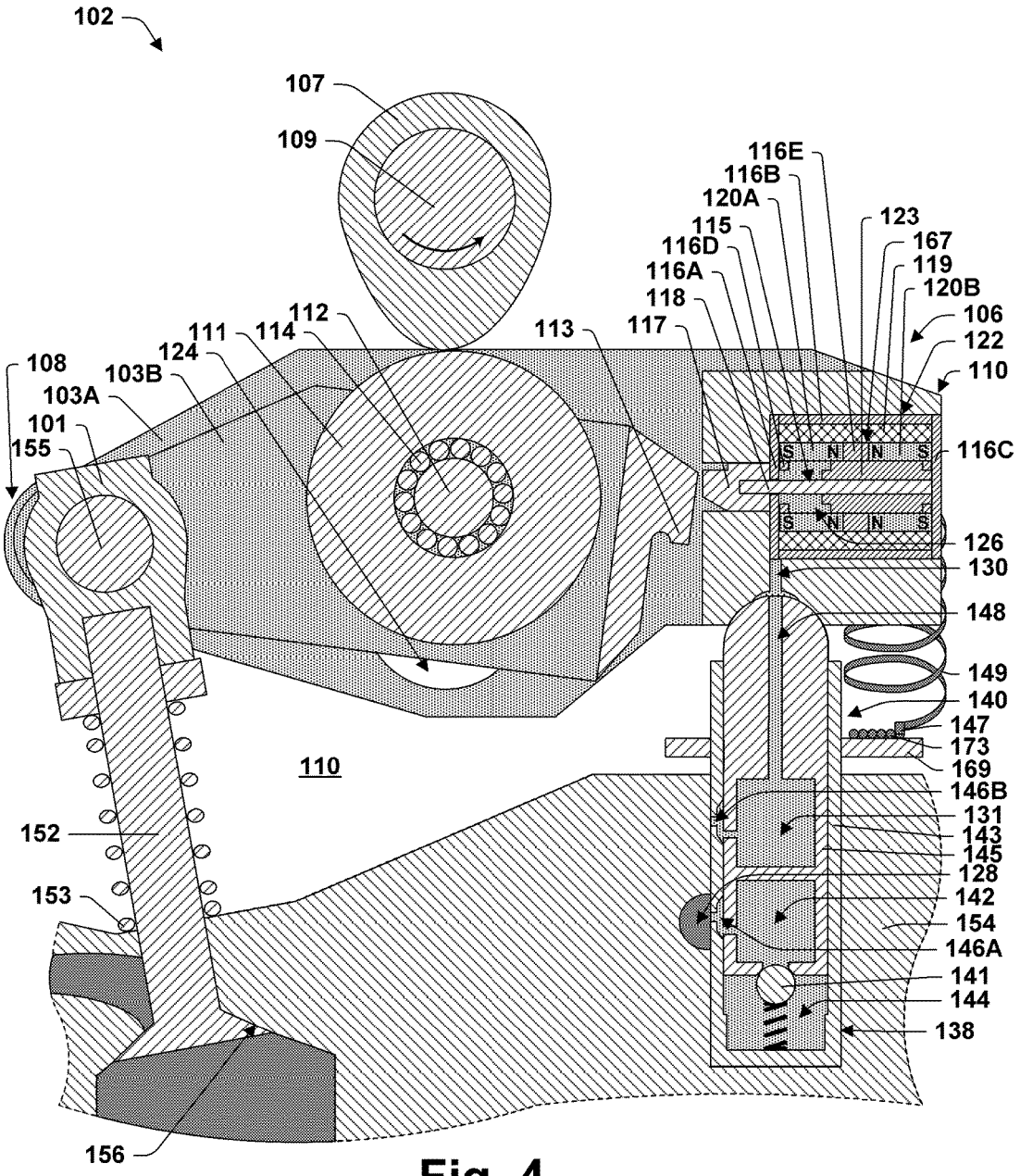
FIG. 4 provides the view of FIG. 2 but with the cam risen off base circle.
Figure 5:
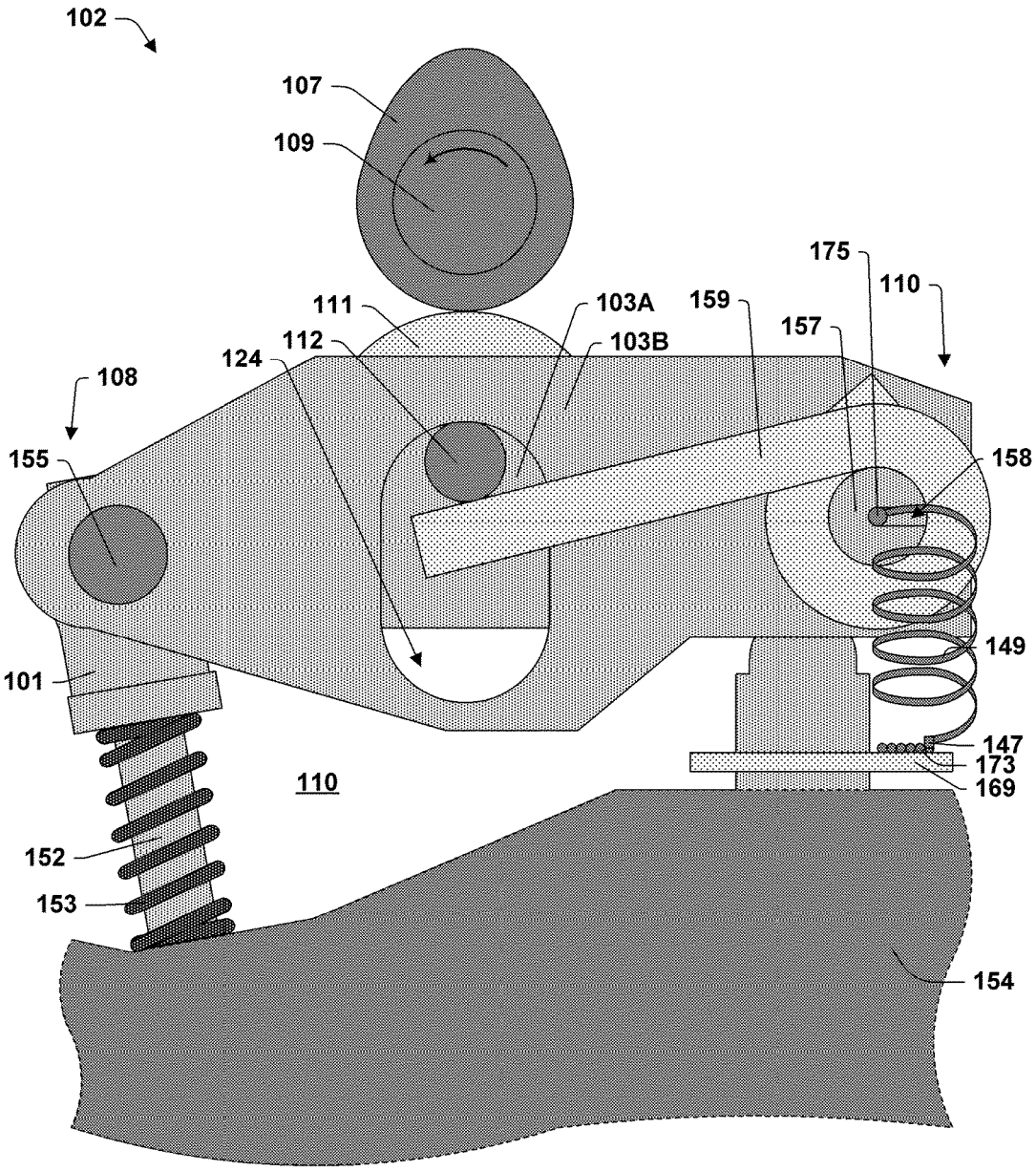
FIG. 5 provides a side view corresponding to the view of FIG. 1.

FIGS. 1-5 illustrate an internal combustion engine 102 according to some aspects of the present teachings. The views of FIGS. 1-4 are cutaway side views. FIG. 5 is a non-cutaway side view corresponding to FIG. 1. Internal combustion engine 102 includes a rocker arm assembly 106, a poppet valve 152, and a cam shaft 109 on which is mounted a cam 107. Rocker arm assembly 106 includes an outer arm 103A, an inner arm 103B, and a hydraulic lash adjuster 140. Outer arm 103A and inner arm 103B are selectively engaged by latch pin 115 of electromagnetic latch assembly 122. Rocker arm assembly 106 is mounted on cylinder head 154. Hydraulic lash adjuster 140 sits within a bore 138 formed in cylinder head 154. Poppet valve 152 has a seat 156 within cylinder head 154.

In some aspects of the present teachings, rocker arms 103 are held in place by contact with hydraulic lash adjuster 140, one or more cams 107, and poppet valve 152. Cam follower 111 is configured to abut and follow cam 107. Cam follower 111 may be rotatably mounted to inner arm 103B through bearings 114 and axle 112. In some of these teachings, cam follower 111 could instead be mounted to outer arm 103A. Rocker arm assembly 106 may include cam followers mounted to both inner arm 103B and outer arm 103A. Cam follower 111 is a roller follower. Another type of cam follower, such as a slider, may be used instead.

Outer arm 103A may be pivotally coupled to inner arm 103B through an axle 155. Axle 155 may also support an elephant's foot 101 through which rocker arm assembly 106 acts on valve 152. Axle 155 may be mounted on bearings or may be rigidly coupled to one of inner arm 103B, outer arm 103A, and elephant's foot 101. As shown in FIG. 5, a torsion spring 159, or a pair thereof, may be mounted to outer arm 103A on spring posts 157. Torsion springs 159 may act upwardly on axle 112 to create torque between inner arm 103B and outer arm 103A about axle 155 and bias cam follower 111 against cam 107. Openings 124 may be formed in outer arm 105 to allow axle 112 to pass through it and move freely up and down.

Figure 2:
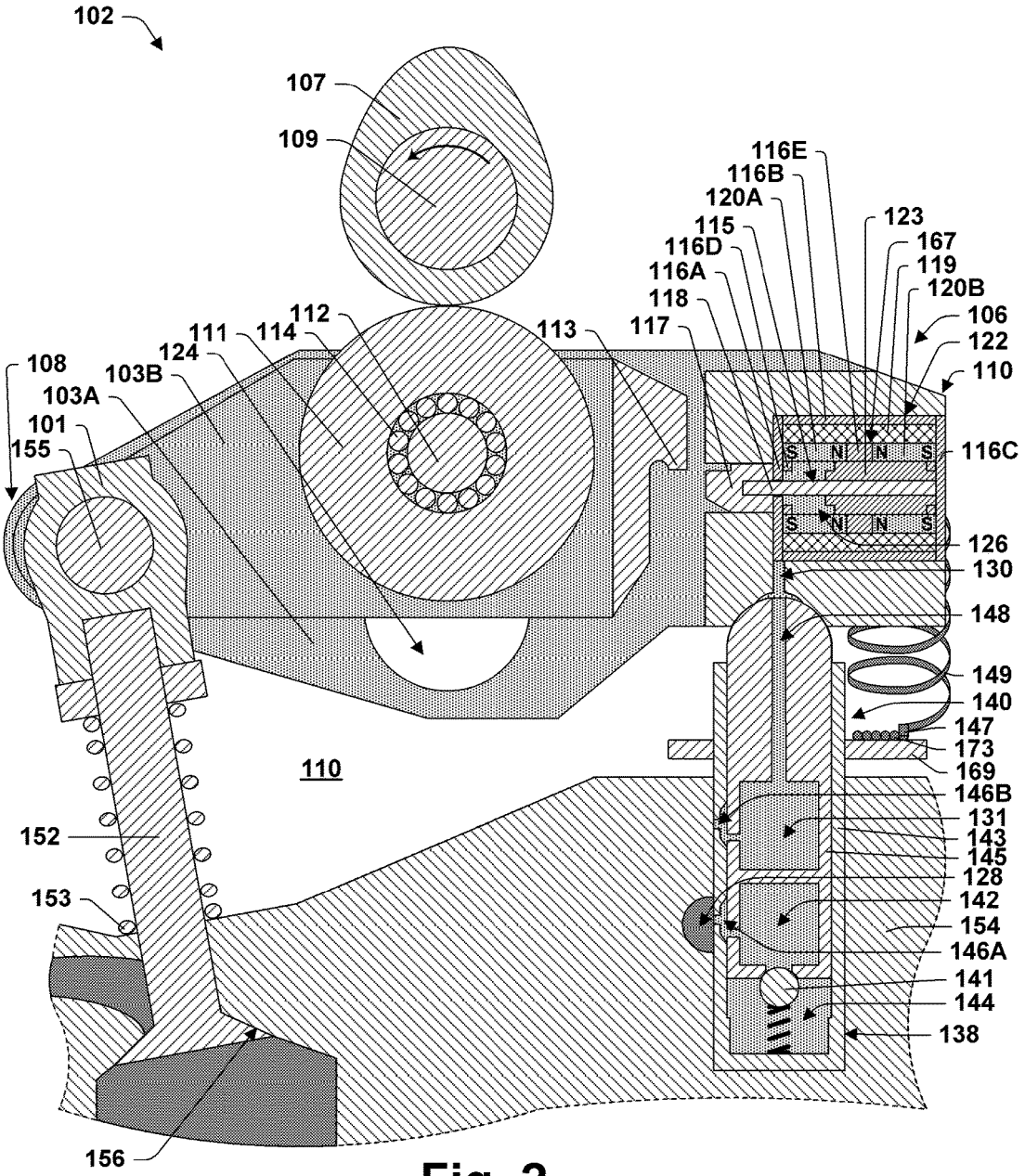
FIG. 2 provides the view of FIG. 1 but with the rocker arm assembly in a latching configuration.

FIG. 1 illustrates internal combustion engine 102 with cam 107 on base circle and latch pin 115 extended. This may be described an engaging position for latch pin 115 or an engaging configuration for rocker arm assembly 106. FIG. 2 shows the result if cam 107 is rotated off base circle while latch pin 115 is in the engaging position. Initially head 115 of latch pin 115 engages lip 113 of inner arm 103B. The force of cam 107 on cam follower 111 may then cause both inner arm 103B and outer arm 103A to pivot together on hydraulic lash adjuster 140, bearing down on valve 152 and compressing valve spring 153. Valve 152 may be lifted off its seat 156 with a valve lift profile determined by the shape of cam 107. The valve lift profile is the shape of a plot showing the height by which valve 152 is lifted of its seat 156 as a function of angular position of cam shaft 109. In this configuration, cam shaft 109 may do work on rocker arm assembly 106 as cam 107 rises off base circle. Much of the resulting energy may be taken up by valve spring 153 and returned to cam shaft 109 as cam 107 descend back toward base circle.

Electromagnetic actuator 122 may be operated to retract latch pin 115. FIG. 3 illustrates internal combustion engine 102 with cam 107 on base circle and latch pin 115 retracted. This may be described a non-engaging position for latch pin 115 or a non-engaging configuration for rocker arm assembly 106. FIG. 4 shows the result if cam 107 is rotated off base circle while latch pin 115 is in the non-engaging position. In this configuration, the downward force on cam follower 111 applied by cam 107 as it rises off base circle may be distributed between valve 152 and torsion springs 159. Torsions springs 159 may be tuned relative to valve spring 153 such that torsion springs 159 yield in the unlatched configuration while valve spring 153 does not. Torsion springs 159 may wind when inner arm 103B descends while outer arm 103A remains in place. As a result, valve 152 may remain on its seat 156 even as cam 107 rises off base circle. In this configuration, cam shaft 109 still does work on rocker arm assembly 106 as cam 107 rises of base circle. But in this case, most of the resulting energy is taken up by torsions springs 159, which act as lost motion springs.

Hydraulic lash adjuster 140 may be replaced by a static fulcrum or other type of lash adjuster. Hydraulic lash adjuster 140 may include an inner sleeve 145 and an outer sleeve 143. Lash adjustment may be implemented using a hydraulic chamber 144 that is configured to vary in volume as hydraulic lash adjuster 140 extends or contracts through relative motion of inner sleeve 145 and outer sleeve 143. A supply port 146A may allow a reservoir chamber 142 to be filled from an oil gallery 128 in cylinder block 154. The fluid may be engine oil, which may be supplied at a pressure of about 2 atm. When cam 107 is on base circle, this pressure may be sufficient to open check valve 141, which admits oil into hydraulic chamber 144. The oil may fill hydraulic chamber 144, extending hydraulic lash adjuster 140 until there is no lash between cam 107 and roller follower 111. As cam 107 rises off base circle, hydraulic lash adjuster 140 may be compressed, pressure in hydraulic chamber 144 may rise, and check valve 141 may consequently close.

In accordance with some aspects of the present teachings, rocker arm assembly 106 may have been originally designed for use with a hydraulically latching rocker arm assembly. Accordingly a second supply port 146B may be formed in hydraulic lash adjuster 140 and communicate with a second reservoir chamber 131 in hydraulic lash adjuster 154. Cylinder head 154 may not include any provision for supplying oil to second supply port 146B. Second reservoir chamber 131 may be isolated from any substantial flow of hydraulic fluid in cylinder head 154. Reservoir chamber 131 and hydraulic passages communicating therewith may be essentially non-functional in engine 102.

Internal combustion engine 102 has an end pivot overhead cam (OHC) type valvetrain. But some of the present teaching are applicable to internal combustion engines having other types of valvetrains including, for example, other types of OHC valvetrains and overhead valve (OHV) valvetrains that may include rocker arm assemblies that are latched. As used in the present disclosure, the term "rocker arm assembly" may refer to any assembly of components that is structured and positioned to actuate valve 152 in response to rotation of a cam shaft 109. Rocker arm assembly 106 is a cylinder deactivating rocker arm. But some of the present teaching are applicable to switching rocker arms and other types of rocker arm assemblies In some of these teachings, a rocker arm is a unitary metal piece. But a rocker arm may include multiple parts that are rigidly joined.

In accordance with some aspects of the present teachings, components of electromagnetic latch assembly 122 are mounted within a chamber 126 formed in rocker arm 103A of rocker arm assembly 106. Electromagnetic latch assembly 122 includes solenoid 119, permanent magnets 120A, and permanent magnet 120B, each of which is rigidly mounted to rocker arm 103A. These parts may be rigidly mounted to rocker arm 103A by being rigidly mounted to other parts that are themselves rigidly mounted to rocker arm 103A. Electromagnetic latch assembly 122 further include latch pin 115 and low coercivity ferromagnetic pieces 116A, 116B, 116C, 116D, and 116E.

Latch pin 115 includes latch pin body 118, latch head 117, and a low coercivity ferromagnetic portion 123. Low coercivity ferromagnetic portion 123 may be part of latch pin body 118 or may be a separate component such as an annular structure fitting around latch pin body 118. Low coercivity ferromagnetic portion 123 provides a low reluctance pathway for magnetic circuits passing through latch pin 115 and may facilitate the application of magnetic forces to latch pin 115.

Low coercivity ferromagnetic pieces 116 may be described as pole pieces in that they are operative within electromagnetic latch assembly 122 to guide magnetic flux from the poles of permanent magnets 120. Low coercivity ferromagnetic pieces 116A, 1168, and 116C are located outside solenoid 119 and may form a shell around it. Low coercivity ferromagnetic pieces 116D may provide stepped edges in magnetic circuits formed by electromagnetic latch assembly 122. Low coercivity ferromagnetic portion 123 of latch pin 115 may be shaped to mate with these edges. During actuation, magnetic flux may cross an air gap between one of these stepped edge and latch pin 115, in which case the stepped edge may be operative to increase the magnetic forces through which latch pin 115 is actuated.

Solenoid 119 comprises a large number of coils that wrap around a volume 167. In some of these teaching permanent magnets 120 are positioned within volume 167. Low coercivity ferromagnetic pieces 116D and 116E may also be positioned within volume 167. In some of these teachings, permanent magnets 120A and permanent magnets 120B are arranged with confronting polarities. In some of these teachings, Low coercivity ferromagnetic piece 116E is positioned between the confronting poles and provides a pole piece for both magnets 120. In some of these teachings, permanent magnets 120A and 120B are located at distal ends of volume 167. In some of these teachings, permanent magnets 120 are annular in shape and polarized in a direction parallel to that in which latch pin 115 translates. This may be along a central axis for solenoid 119.

In accordance with some aspects of the present teachings, electromagnetic latch assembly 122 provides both extended and retracted positions in which latch pin 115 is stable. As a consequence, either the latched or unlatched configuration can be reliably maintained without solenoid 119 being powered. Positional stability refers to the tendency of latch pin 115 to remain in and return to a particular position. Stability is provided by restorative forces that acts against small perturbations of latch pin 115 from a stable position. In accordance with some of the present teachings, in electromagnetic latch assembly 122 stabilizing forces are provided by permanent magnets 120. Alternatively or in addition, one or more springs may be positioned to provide positional stability. Springs may also be used to bias latch pin 115 out of a stable position, which may be useful for increasing actuation speed.

Figure 6:
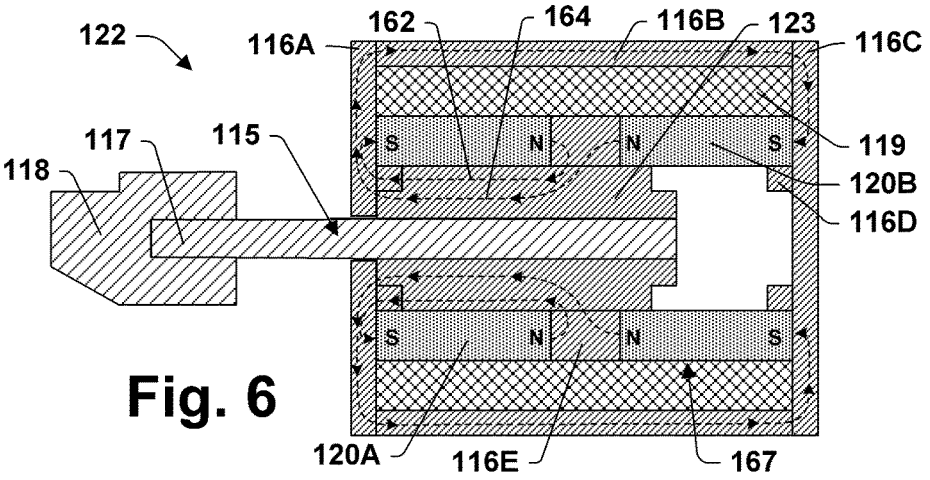
FIG. 6 is a cross-section side view of an electromagnetic latch assembly according to some aspects of the present teachings with the latch pin in an extended position.
Figure 8:
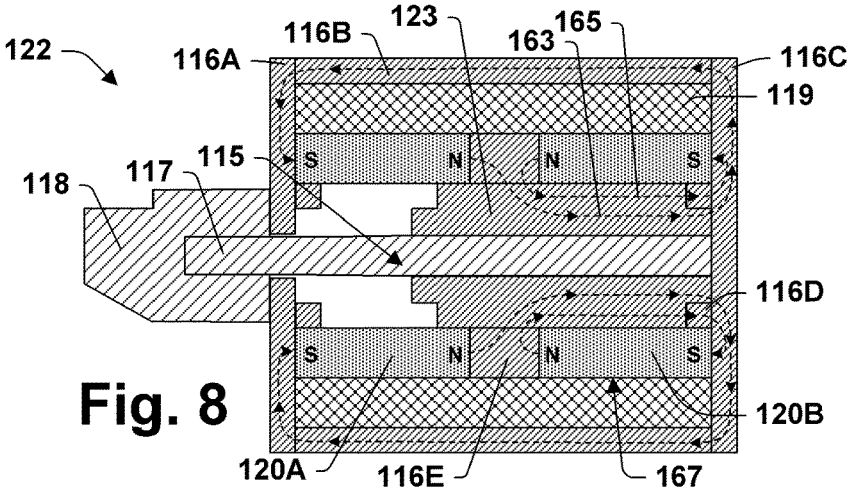
FIG. 8 provides the view of FIG. 6 but with the latch pin in a retracted position.

In accordance with some aspects of the present teachings and as shown in FIGS. 6 and 8, electromagnetic latch assembly 122, permanent magnet 120A stabilizes latch pin 115 in both the extended and the retracted positions. In accordance with other aspects of the present teachings, electromagnetic latch assembly 122 forms two distinct magnetic circuits 162 and 163 to provide this functionality. As shown in FIG. 6, magnetic circuit 162 is operative to be the primary path for magnet flux from permanent magnet 120A when latch pin 115 is in the extended position, absent magnetic fields from solenoid 119 or any external source that might alter the path taken by flux from permanent magnet 120A.

Magnetic circuit 162 proceeds from the north pole of permanent magnet 120A, through pole piece 116E, through latch pin 115, through a pole piece 116D and pole piece 116A and ends at the south pole of permanent magnet 120A. Path 163 is operative to be the primary path for magnet flux from permanent magnet 120A when latch pin 115 is in the extend position. A primary magnetic circuit is a magnetic circuit taken by the majority of flux from a magnet. Perturbation of latch pin 115 from the extended position would introduce an air gap into magnetic circuit 162, increasing its magnetic reluctance. Therefore, the magnetic forces produced by permanent magnet 120A resist such perturbations.

As shown in FIG. 8, magnetic circuit 163 is operative to be the primary path for magnet flux from permanent magnet 120A when latch pin 115 is in the retracted position, absent magnetic fields from solenoid 119 or any external source that might alter the path taken by flux from permanent magnet 120A. Magnetic circuit 163 proceeds from the north pole of permanent magnet 120A, through pole piece 116E, through latch pin 115, through a pole piece 116D, through pole pieces 116C, 116B, and 116A, and ends at the south pole of permanent magnet 120A. Path 163 is operative to be the primary path for magnet flux from permanent magnet 120A when latch pin 115 is in the retracted position. Perturbations of latch pin 115 from the retracted position would introduce an air gap into magnetic circuit 162, increasing its magnetic reluctance. Therefore, the magnetic forces produced by permanent magnet 120A resist such perturbations.

In accordance with some aspects of the present teachings, electromagnetic latch assembly 122 also includes a second permanent magnet 120B that is also operative to stabilize latch pin 115 in both the extended and the retracted positions. Electromagnetic latch assembly 122 forms two distinct magnetic circuits 164 and 165 for magnetic flux from second permanent magnet 120B. Magnetic circuit 164 is operative to be the primary path for magnet flux from permanent magnet 120B when latch pin 115 is in the extended position and magnetic circuit 165 is operative to be the primary path for magnet flux from permanent magnet 120B when latch pin 115 is in the retracted position. Like magnetic circuit 162, magnetic circuit 165 goes around the outside of solenoid 119. Like magnetic circuit 163, magnetic circuit 164 does not.

Figure 7:
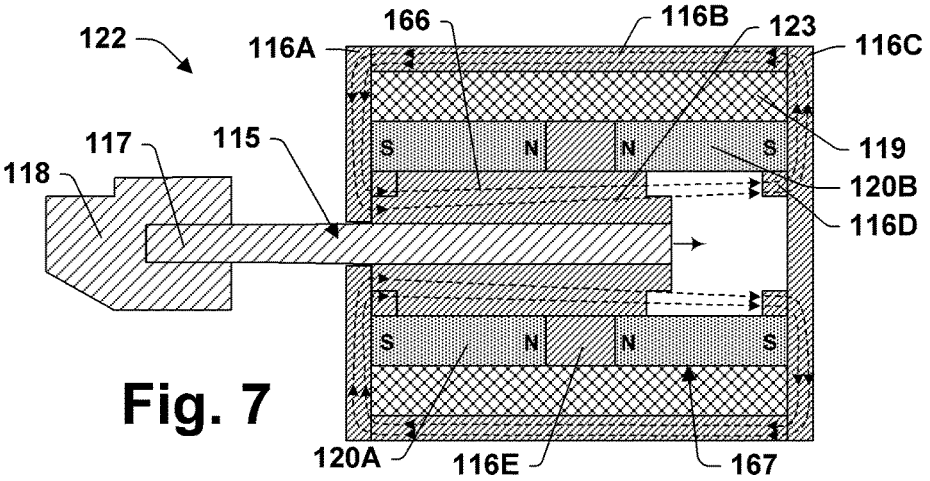
FIG. 7 provides the same view as FIG. 6, but illustrating magnetic flux that may be generated by the solenoid.

Electromagnetic latch assembly 122 is structured to operate through a magnetic circuit shifting mechanism. FIG. 7 illustrates this for the case in which solenoid 119 is operated to induce latch pin to actuate from the extended position to the retracted position. A voltage of suitable polarity may be applied to solenoid 119 to induce magnetic flux following the circuit 161. The magnetic flux from solenoid 119 reverses the magnetic polarity in low coercivity ferromagnetic elements forming the magnetic circuits 162 and 164 through which permanent magnets 120 stabilized latch pin 115 in the extended position. This greatly increase the reluctance of magnetic circuit 162 and 164. Magnetic flux from permanent magnets 120 may shift from magnetic circuits 162 and 164 toward magnetic circuits 163 and 16. The net magnetic forces on latch pin 115 may drive it to the retracted position shown in FIG. 8. In accordance with some aspects of the present teachings, the total air gap in the magnetic circuit 161 taken by flux from solenoid 119 does not vary as latch pin 115 actuates. This feature may relate to operability through a flux shifting mechanism.

One way in which electromagnetic latch assembly 122 may be identified as having a structure that provides for a magnetic circuit shifting mechanism is that solenoid 119 does not need to do work on latch pin 115 throughout its traverse from the extended position to the retracted position or vis-versa. While permanent magnets 220 may initially holds latch pin 115 in a first position, at some point during latch pin 115's progress toward the second position, permanent magnets 220 begins to attract latch pin 115 toward the second position. Accordingly, at some point during latch pin 115's progress, solenoid 119 may be disconnected from its power source and latch pin 115 will still complete its travel to the second position. And as a further indication that a magnetic circuit shifting is formed by the structure, a corresponding statement may be made in operation of solenoid 119 to induce actuation from the second position back to the first. Put another way, a permanent magnet 220 that is operative to attract latch pin 115 into the first position is also operative to attract latch pin 115 into the second position.

As used herein, a permanent magnet is a high coercivity ferromagnetic material with residual magnetism. A high coercivity means that the polarity of permanent magnet 120 remains unchanged through hundreds of operations through which electromagnetic latch assembly 122 is operated to switch latch pin 115 between the extended and retracted positions. Examples of high coercivity ferromagnetic materials include compositions of AlNiCo and NdFeB.

Magnetic circuits 162, 163, 164, 165 may be formed by low coercivity ferromagnetic material, such as soft iron. These circuit may have little or no air gaps. Magnetic circuits 162, 163, 164, 165 may have low magnetic reluctance. In accordance with some aspects of the present teachings, permanent magnets 120 have at least one low reluctance magnetic circuit available to them in each of the extended and retracted positions. These paths may be operative as magnetic keepers, maintaining polarization and extending the operating life of permanent magnets 120.

Low coercivity ferromagnetic pieces 116 may form a shell around solenoid 119. In some of these teachings, a rocker arm 103 to which solenoid 119 is mounted is formed of a low coercivity ferromagnetic material, such as a suitable steel, and the rocker arm 103 may be consider as providing these pieces or fulfilling their function.

In accordance with some aspects of the present teachings, magnetic circuits 162 and 165 are short magnetic circuits between the poles of permanent magnets 120A and 120B respectively. Magnetic circuits 162 and 165 pass through low coercivity ferromagnetic portion 123 of latch pin 115 but not around the coils of solenoid 119. These short magnetic circuits may reduce magnetic flux leakage and allow permanent magnets 120 to provide a high holding force for latch pin 115. Magnetic circuits 163 and 164, on the other hand, pass around the coils of solenoid 119. Routing these magnetic circuits around the outside of solenoid 119 may keep them from interfering with the shorter magnetic circuits. These longer, alternate magnetic circuits can allow permanent magnets 120 to contribute to stabilizing latch pin 115 in both extended and retracted positions and can assure there is a low reluctance magnetic circuit to help maintain the polarization of permanent magnets 120 regardless of whether latch pin 115 is in the extended or the retracted position.

In accordance with some aspects of the present teachings, electromagnetic latch assembly 122 is operative to actuate latch pin 115 between the extended and retracted positions by redirecting flux from permanent magnet 120.

In accordance with some aspects of the present teachings, solenoid 119 is powered by circuitry (not shown) that allows the polarity of a voltage applied to solenoid 119 to be reversed. A conventional solenoid switch forms a magnetic circuit that include an air gap, a spring that tends to enlarge the air gap, and an armature moveable to reduce the air gap. Moving the armature to reduce the air gap reduces the magnetic reluctance of that circuit. As a consequence, energizing a conventional solenoid switch causes the armature to move in the direction that reduces the air gap regardless of the direction of the current through the solenoid or the polarity of the resulting magnetic field. As described above, however, latch pin 115 of electromagnetic latch assembly 122 may be moved in either one direction or another depending on the polarity of the magnetic field generated by solenoid 119. Circuitry, an H-bridge for example, that allows the polarity of the applied voltage to be reversed enables the operation of electromagnetic latch assembly 122 for actuating latch pin 115 to either an extended or a retracted position. Alternatively, one voltage source may be provided for extending latch pin 115 and another for retracting latch pin 115. Another alternative is provide solenoid 119 as two electrically isolated coils, one with coils wound in a first direction and the other with coils wound in the opposite direction. One or the other set of coils may be energized depending on the position in which it is desired to place latch pin 115.

Figure 9:
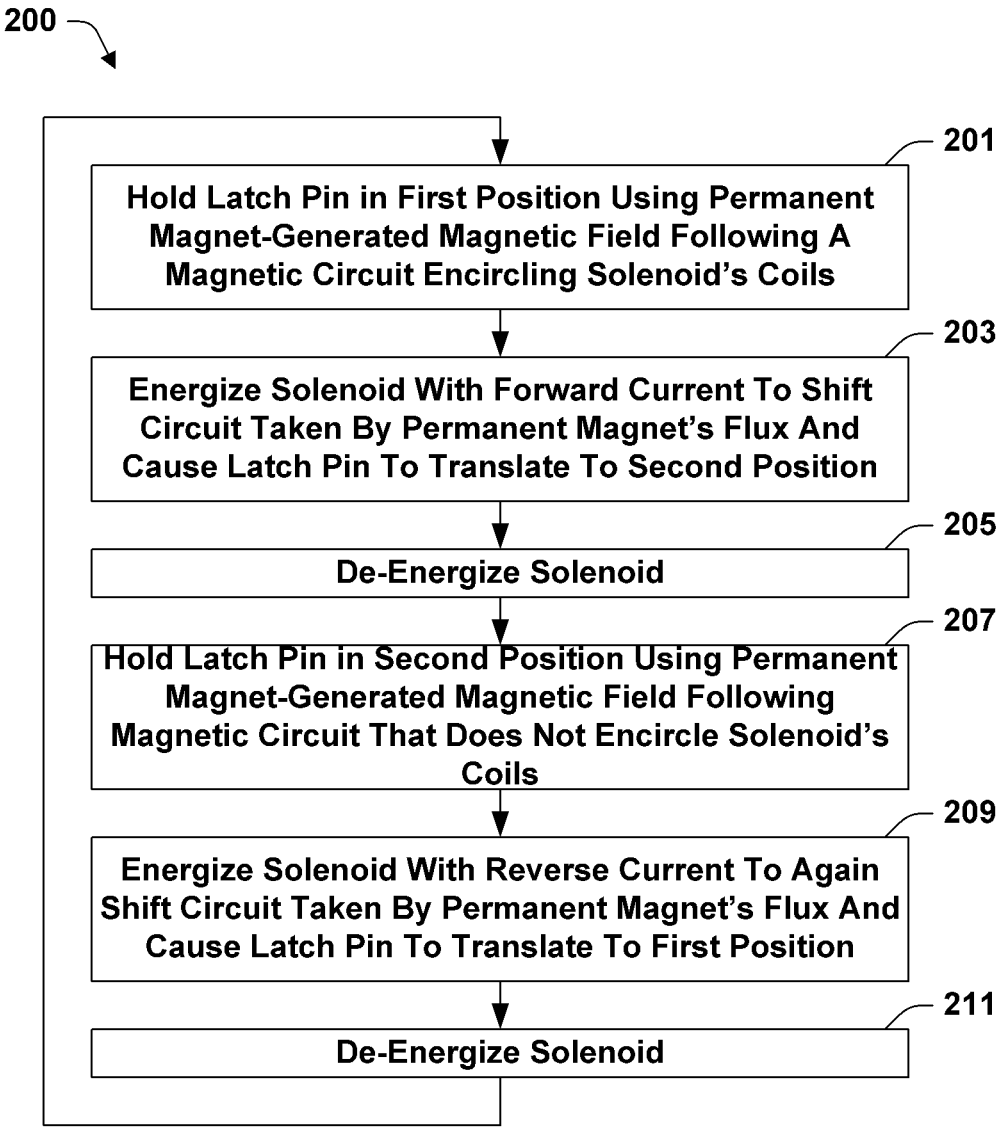
FIG. 9 is a flow chart of a method of operating an internal combustion engine, or a rocker arm assembly thereof, according to some aspects of the present teachings.

FIG. 9 provides a flow chart of a method 200 according to some aspects of the present teachings that may be used to operate internal combustion engine 102. Method 200 begins with action 201, holding latch pin 115 in a first position using a magnetic field generated by a first permanent magnet 120A and following a magnetic circuit 163 that encircles the coils of solenoid 119. Such a magnetic circuit may include a segment passing through solenoid 119 and a segment that is outside solenoid 119. The first position may correspond to either an extended or a retracted position for latch pin 115. In some of these teachings, action 201 further includes holding latch pin 115 in the first position using a magnetic field generated by a second permanent magnet 120B and following a shorter magnetic circuit 165 that does not encircles the coils of solenoid 119.

Method 200 continues with action 203, energizing solenoid 119 with a current in a forward direction to alter the circuit taken by flux from first permanent magnet 120A and cause latch pin 115 to translate to a second position. Energizing solenoid 119 with a current in a forward direction may also alter the circuit taken by flux from a second permanent magnet 120B. Action 203 may be initiated by an automatic controller. In some of these teachings, the controller is an ECU.

Following translation of latch pin 115 to the second position through action 203, solenoid 119 may be disconnected from its power source with action 205. Method 200 then continues with action 207, holding latch pin 115 in the second position using a magnetic field generated by a first permanent magnet 120A and following a magnetic circuit 162 that does not encircles the coils of solenoid 119. This may be a short magnetic circuit with low magnetic flux leakage. In some of these teachings, action 207 further includes holding latch pin 115 in the second position using a magnetic field generated by a second permanent magnet 120B and following a magnetic circuit 164 that encircles the coils of solenoid 119.

Method 200 may continue with action 211, energizing solenoid 119 with a current in a reverse direction to again alter the circuit taken by flux from first permanent magnet 120A and cause latch pin 115 to translate back to the first position. Energizing solenoid 119 with a current in a reverse direction may also alter the circuit taken by flux from a second permanent magnet 120B. Action 209 also may be initiated by an automatic controller, such as an ECU. Action 211 may then be carried out, again de-energizing solenoid 119. The action of method 200 may subsequently repeat.

In accordance with some aspects of the present teachings, electromagnetic latch assembly 122 has dual positional stability and may be operated by the method 200. In some of the present teachings, however, electromagnetic latch assembly 122 may be a different type of latch such as a conventional solenoid switch that forms a magnetic circuit that include an air gap, a spring that tends to enlarge the air gap, and an armature moveable to reduce the air gap. This conventional switch may have only one stable position, one maintained by a spring for example. The stable position may correspond to an extended or a retracted position for latch pin 115. The other position may be maintained by continuously powering solenoid 119.

In accordance with some aspects of the present disclosure, magnetic components of electromagnetic latch assembly 122 are housed in a chamber 126 formed in rocker arm 105. The magnetic component housed in chamber 126 are permanent magnets 120A and 1206 and solenoid 119. In accordance with some of these teachings, chamber 126 is sealed against intrusion from metal particles that may be in oil dispersed throughout the environment 110 surrounding rocker arm assembly 106. Openings off chamber 126 may be sealed in any suitable manner consistent with the objective. For examples, a Sealing of chamber 126 may be provided in part by a seal around latch pin 115 at a location where latch pin 115 extends out of chamber 126. Pole piece 116C or another component may seal off an opening through which parts of electromagnetic latch assembly 122 may have been installed in chamber 126.

In accordance with some aspects of the present teachings, chamber 126 is a hydraulic chamber. Chamber 126 may have been adapted to house parts of electromagnetic latch assembly 122. In accordance with some of these teachings, rocker arm assembly 106 is made using rocker arms 103 put into production for use with a hydraulically actuated latch.

In accordance with some of these teachings, an electric latch assembly 122 has been installed in place of a hydraulic latch. While chamber 126 is a hydraulic chamber, it need not be functionally connected to a hydraulic system. A hydraulic passage 130 may connect to chamber 126. Hydraulic passage 130 may be blocked to help seal chamber 126. In some of these teaching, hydraulic passage 130 couples with a hydraulic passage 148 formed in hydraulic lash adjuster 140.

In accordance with some aspects of the present teachings, some magnetic components of electromagnetic latch assembly 122 are retained within chamber 126. These may include permanent magnets 120A and 120B and solenoid 119. Alternatively, solenoid 119 may be mounted at any location where it is operative when energized to generate a magnetic field that operates on electromagnetic latch assembly 122 to actuate latch pin 115. Actuating latch pin 115 may be moving latch pin 115 between an extended position and a retracted position.

It has been determined that a solenoid 119 of sufficient power can be fit in a chamber 126 of rocker arm 105. In particular, simulations have shown that solenoid 119 may have a 7.2 mm outer diameter, a 2.5 mm inner diameter, and a 7.9 mm length. It may have 560 turns of 35 AWG copper wire. It may be powered at 9 VDC with a maximum current of 0.8 A. A peak electromagnetic force of 1.65 N on latch pin 115A may be realized with the aid of a shell 118 having a thickness of 0.5 mm. Latch pin weight can be limited to about 2 g. Frictional resistance may be limited to 0.6 N @ 0° C., with much lower friction expected at higher temperatures. Under these conditions, solenoid 119 may drive latch pin 115 through a distance of 1.9 mm in 4 ms. In some of the present teachings, solenoid 119 has a diameter of 20 mm or less. In some of these teachings, solenoid 119 has a diameter of 10 mm or less. These dimensions facilitate fitting solenoid 119 into a chamber 126 formed in rocker arm 105.

In some of the present teachings, the displacement required to actuate latch pin 115 from the first the second position is 5 mm or less, e.g., about 2 mm. Actuating latch pin 115 may be operative to change valve lift timing. In some of these teachings, Rocker arm assembly 106 is a cylinder deactivating rocker arm and actuating latch pin 115 activates or deactivates valve 152. In some alternative teachings, rocker arm assembly 106 is a switching rocker arm. A switching rocker arm may be operative to provide VVL. A switching rocker arm may include an inner arm 103 and an outer arm 105 that are selectively engaged by a latch pin 115 and actuating latch pin 115 switches the valve lift timing between a first profile and a second profile.

Figure 10:
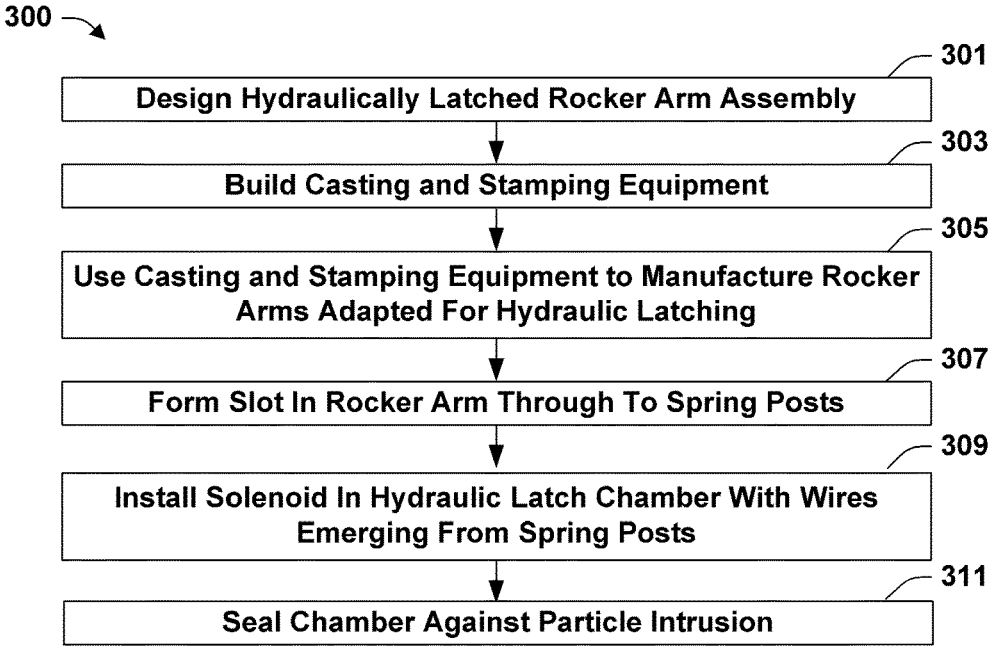
FIG. 10 is a flow chart of a manufacturing method according to some aspects of the present teachings.

FIG. 10 provides a flow chart of a manufacturing method 300 in accordance with some aspects of the present teachings. Method 300 begins with action 301, a design operation in which a rocker arm assembly 106 including a hydraulically actuated latch may be designed in detail. The design may be made without specifications for an electromagnetic latch assembly 122. Method 300 continues with action 303, building casting and stamping equipment sufficient for implementing the design of action 301. Action 305 is using that equipment to manufacture a rocker arm 103A having a hydraulic latch chamber 126.

Figure 11:
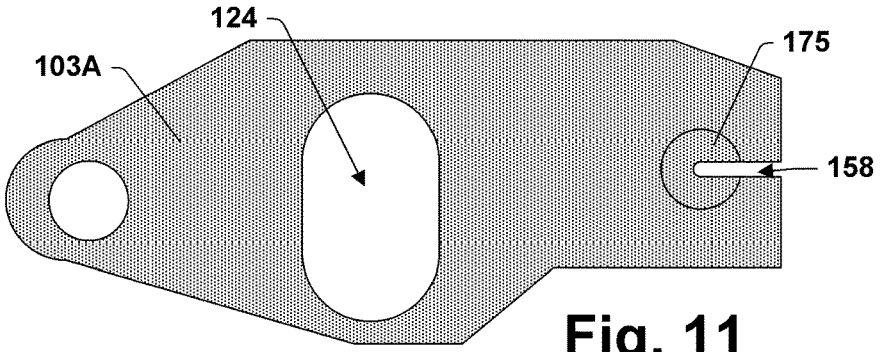
FIG. 11 is a side view of a rocker arm having a slot formed in it in accordance with some aspects of the present teachings.
Figure 12:
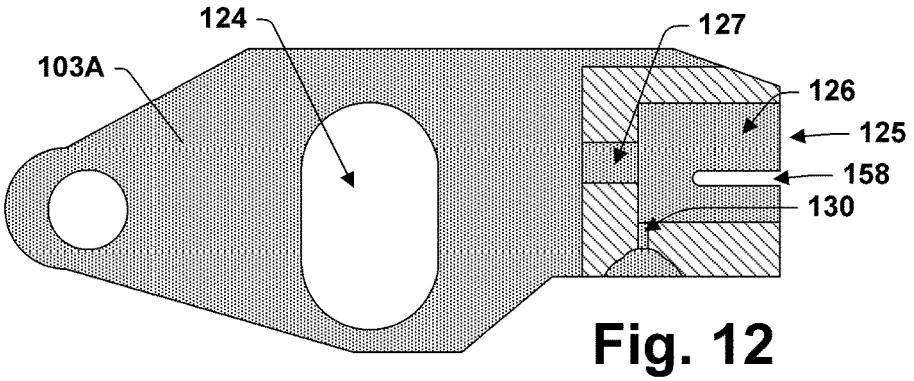
FIG. 12 is a cutaway view corresponding to the side view of FIG. 11.

Act 307 is forming a slot 158 in end 110 of rocker arm 105 through to spring posts 157 as shown in FIGS. 11 and 12. Slot 158 intersects chamber 126. This enables the subsequent act 309, installing solenoid 119 in chamber 126 with a wire 175 emerging from one of the spring posts 157. In some of these teachings, wires 175 may emerge from both spring posts 157. In some others of these teachings, solenoid 119 is grounded through the structure of rocker arm assembly 106 which is in turn grounded through cylinder head 154. In that case, only one wire is required. That wire can be electrically isolated from cylinder head 154 and raised to a substantially higher electrical potential. Optionally, action 309 includes installing the entire electromagnetic latch assembly 122 on rocker arm 103.

Action 311 is sealing hydraulic latch chamber 126 against intrusion by metal particles that may be in oil dispersed in the environment 110 surrounding rocker arm assembly 106. This may include installing a seal ring around an opening 127 out of which latch pin 115 extends, closing off an opening 125 through which electromagnetic latch assembly 122 is installed in chamber 126, closing of a hydraulic passage 130, and closing off slot 158. In some of these teachings, electromagnetic latch assembly 122 itself forms a sealed chamber within hydraulic chamber 126. Electromagnetic latch assembly 122 may be provided with a shell for this purpose. In some of these teachings, electromagnetic latch assembly 122 cooperates with the structure of rocker arm 103A to complete the sealing of chamber 126.

Figure 13:
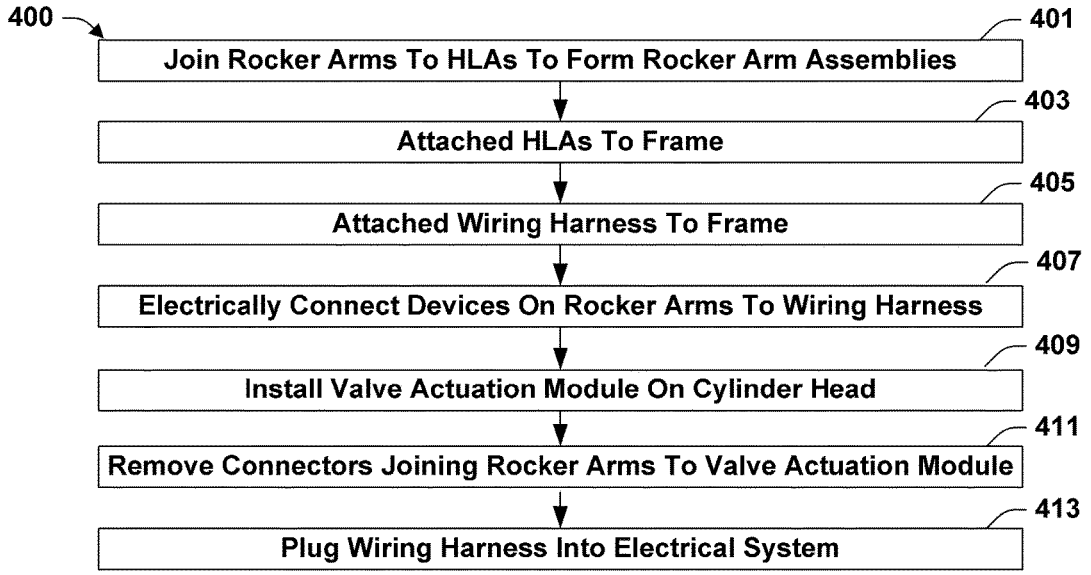
FIG. 13 is a flow chart of another manufacturing method according to some other aspects of the present teachings.
Figure 14:
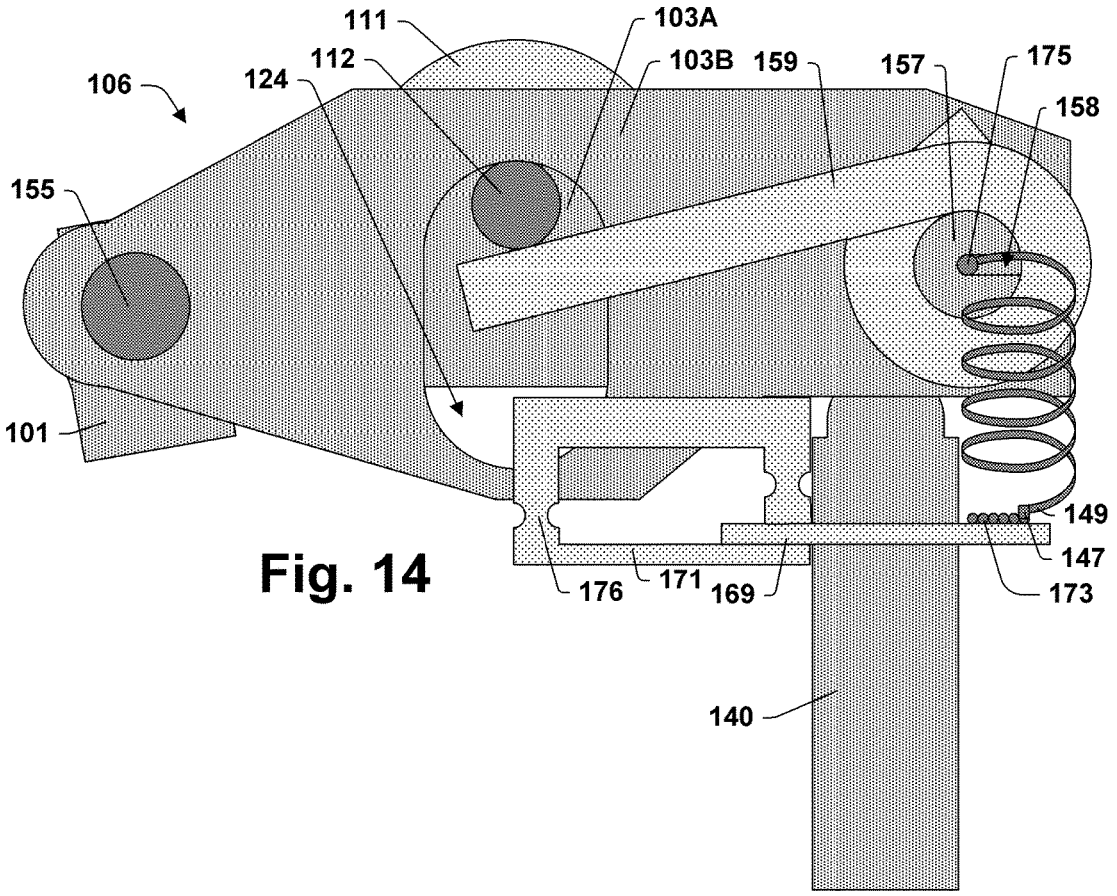
FIG. 14 is a side view of a portion of the rocker arm assembly of FIG. 1 prior to installation in accordance with some aspects of the present teachings.

FIG. 13 is a flow chart of a method 400 of manufacturing an internal combustion engine 102 in accordance with some aspects of the present teachings. Method 400 may begin with action 401, temporarily joining rocker arms 103 and HLAs 140. In accordance with some of the present teaching, these parts may be joined with connectors 171 as shown in FIG. 14. Connectors 171 may be any type of connector that can hold rocker arms 105 and HLAs 140 together during installation and easily removed after installation. In some of these teachings, connectors 171 are made of plastic or cardboard. Connectors 171 may be formed of a material unsuited for engine operating conditions. In some of these teachings, connectors 171 have weak points 176 formed or designed into their structure. Connectors 171 may be identifiable as breakaway connectors. Connectors 171 may join rocker arms 103 and HLAs 140 directly, or may join rocker arms 103 to a frame 168 to which HLAs 140 are joined.

Method 400 may include action 403, attaching HLAs 140 to frame 169. In accordance with the present teachings, frame 169 maintains spacing between HLAs 140 that is equivalent to their spacing when installed within internal combustion engine 102. In some of these teachings, frame 169 wraps at least most of the way around a cylindrical portion of each of the HLAs 140.

Action 405 is attaching a wiring harness 168 to frame 169. Wiring harness 168 may include a plurality of wires 173 connecting to distinct HLAs 140. Each of the wires 173 may be coupled to a separate pin of connection plug 174. Wiring harness 168 may provide a conduit surrounding and protecting wires 173.

Figure 15:
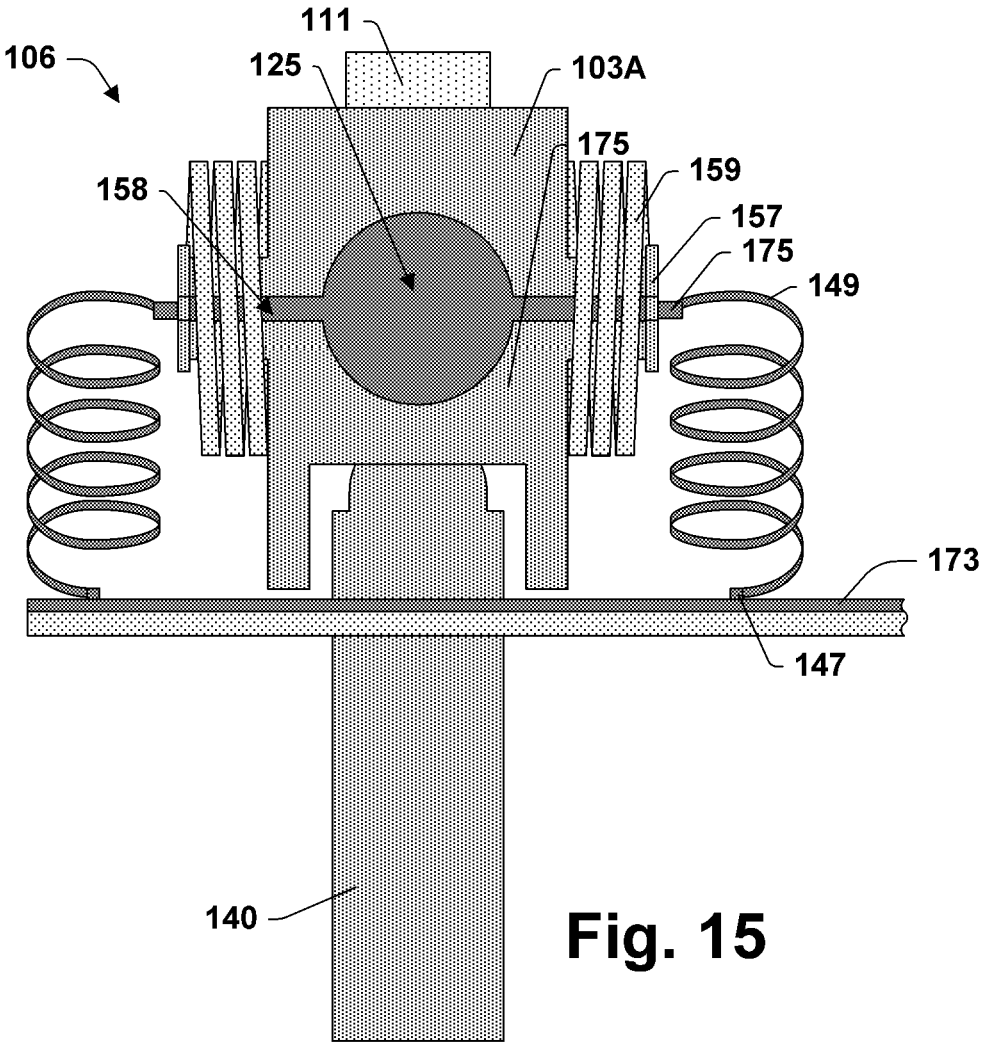
FIG. 15 is a rear view of the rocker arm assembly of FIG. 1.

Action 407 is installing connectors 149 that make electrical connections between wires 173 of wiring harness 168 and wires 147 of solenoids 119. In accordance with some aspects of the present teachings, connectors 149 are formed with springs 149 as shown in FIG. 15. Spring 149 may have a natural frequency greater than 500 Hz. The same springs 149 that provide this degree of stiffness may also be operative to carry current form solenoid 119. Alternatively, wire traces may be provided on the springs 149 for carrying the current. Another option is to bind current carrying wires along the length of the springs 149. Bound along the length means continuously bound or multiple bindings distributed along the length.

Figure 16:
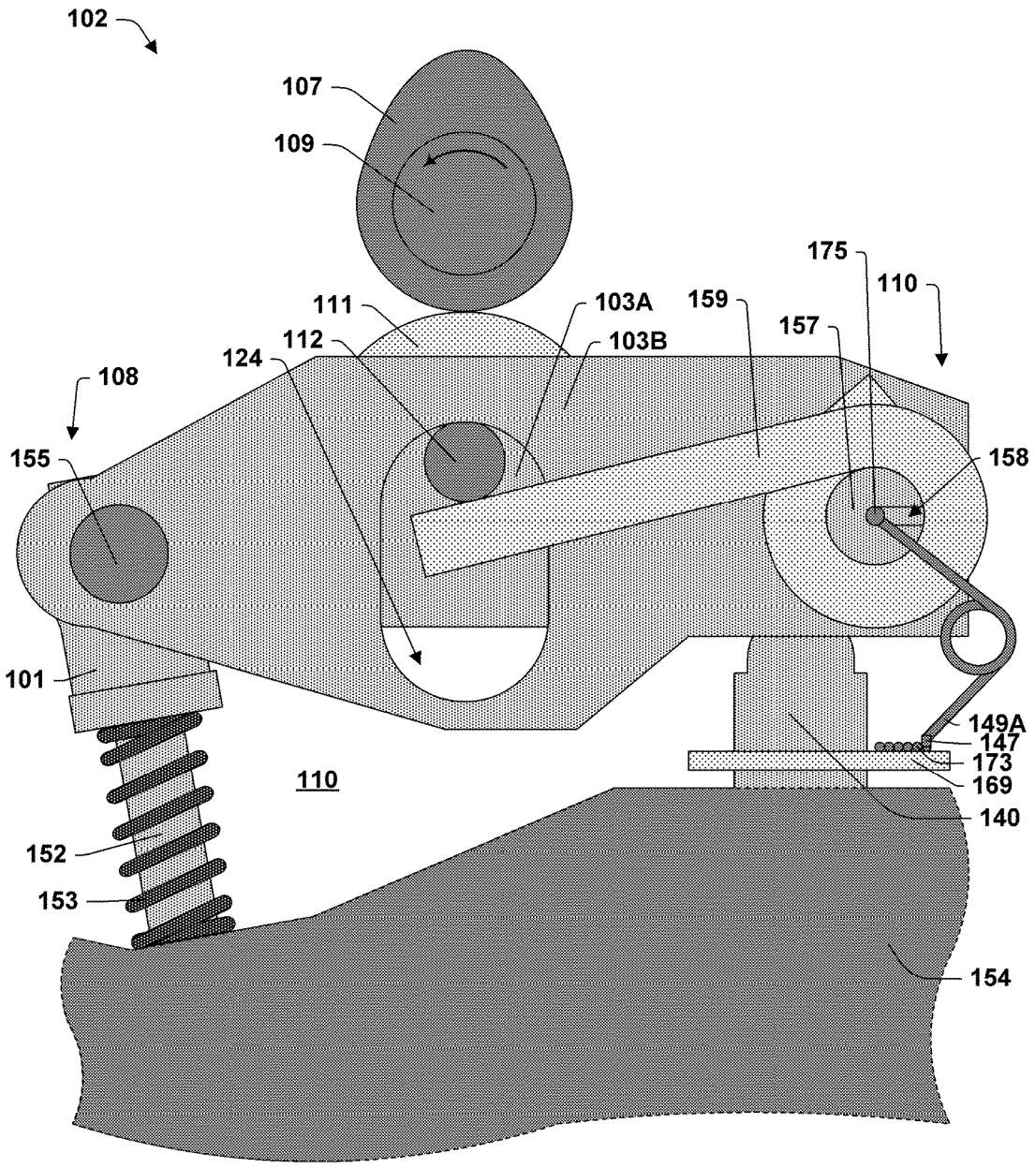
FIG. 16 is a side view of a portion of another internal combustion according to some aspects of the present teachings

Springs 149 may be any suitable type of spring. In most of the illustrations, spring 149 are shown as being formed from a coiled metal ribbon. FIG. 16 shows an alternative design with springs 149A in the form of spring clips. The present teaching of using springs 149 to form electrical connections to a rocker arm 103 are applicable to powering or communicating with any type of electrical device that may be mounted on rocker arm 103. The connection may be made from rocker arm 103 to any suitable location. A suitable location may be stationary with respect to cylinder head 154.

In some of the present teachings, springs 149 are used to form connections to a wiring harness 168. In some of these teachings, wiring harness 168 is mounted to a frame 169. Frame 169 may be mounted at any suitable location. A suitable location may be stationary with respect to cylinder head 154. In some of these teachings frame 169 is mounted to HLAs 140. In some of these teachings frame 169 is mounted to cylinder head 140, a cam carrier (not shown), or a valve cover (not shown). In alternate teachings, springs 149 make connections to a wiring harness 168 that is mounted directly to an HLA 140, a cylinder head 140, a cam carrier, or a valve cover.

Alternatively, solenoids 119 may be electrically connected to wiring harness 168 and connection plug 174 without springs. For example, the connections can be made with wires that are specially designed to endure the motion induced by rocker arm 103A. If such wires are used, they may be connected to solenoids 119 prior to mounting on rocker arm 103A in accordance with method 300. According to some aspects of the present teachings, prior to mounting solenoid 119 on rocker arm 103A, wires are connected to solenoid 119 having sufficient length to run continuously from solenoids 119 to connection plug 174. Such wires can be gathered together to form wiring harness 168.

Figure 17:
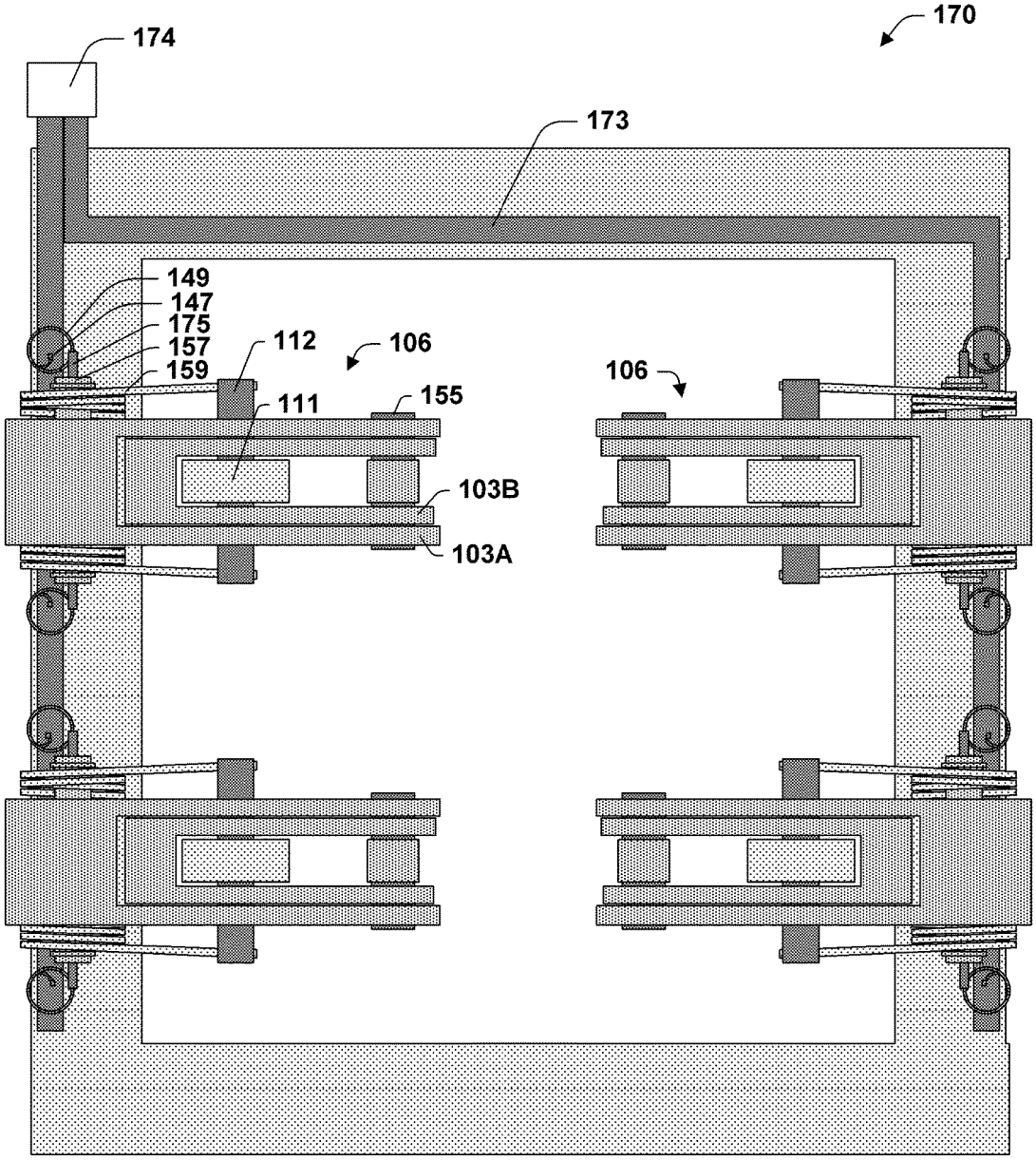
FIG. 17 illustrates a valve actuations according to some aspects of the present teachings.

Actions 401 through 407 together form a valve actuation module 170 in accordance with some aspects of the present teachings. A valve actuation module 170 in accordance with these teachings is illustrated by FIG. 17. In accordance with some of these teachings, valve actuation module 170 includes at least two rocker arm assemblies 160. In some of these teachings, valve actuation module 170 includes four rocker arm assemblies 160. Four rocker arm assemblies 160 may be the number installed between adjacent pairs of cam towers (not shown) in engine 102. In accordance with some of these teachings, valve actuation module 170 includes electrical connections for a plurality of solenoids 119.

Action 409 is installing valve actuation module 170 in cylinder head 154. In accordance with the present teachings, this may include installing all the HLAs 140 of valve actuation module 170 simultaneously in openings formed in cylinder head 154. Action 409 may be simply dropping valve actuation module 170 onto cylinder head 154. Action 411 is removing the connectors 171 joining rocker arms 103 to HLAs 140 or frame 169. Action 413 is plugging connection plug 174 into the electrical system (not shown) of internal combustion engine 102. The actions of method 400 may take place in any order consistent with the logic of this method.

The components and features of the present disclosure have been shown and/or described in terms of certain teachings and examples. While a particular component or feature, or a broad or narrow formulation of that component or feature, may have been described in relation to only some aspects of the present teachings or some examples, all components and features in either their broad or narrow formulations may be combined with other components or features to the extent such combinations would be recognized as logical by one of ordinary skill in the art.

The claims are:

1. A method of installing a valvetrain in an internal combustion engine of a type that includes, a cylinder head, a poppet valve having a seat within the cylinder head, a cam shaft on which is mounted an eccentrically shaped cam, an electromagnetic latch assembly comprising a latch pin translatable between a first position and a second position, a rocker arm assembly that abuts the poppet valve and includes a cam follower and a rocker arm, and a hydraulic lash adjuster providing a fulcrum for the rocker arm assembly, the method comprising:

attaching the rocker arm assembly and the hydraulic lash adjuster to a frame to form a module; and installing the module on the cylinder head;

wherein an electromagnet forming part of the electromagnetic latch assembly is mounted to the rocker arm;

a wiring harness is bound to the frame; and an electrical connection is made from the wiring harness to the electromagnet.

2. The method according to claim 1, further comprising connecting the electromagnet to circuitry operable to energize the electromagnet with a current in either a first direction or a second direction, which is opposite the first direction.

3. The method according to claim 1, wherein the electromagnet is mounted to the rocker arm within a chamber formed by the rocker arm.

4. The method of claim 1, wherein the rocker arm assembly is one of a plurality of rocker arm assemblies attached to the frame to form the module.

5. The method of claim 4, wherein:

the electromagnet is one of a plurality of electromagnets;

the rocker arm is one of a plurality of rocker arms;

the electromagnetic latch assembly is one of a plurality of electromagnetic latch assemblies;

each of the plurality of rocker assemblies comprising a corresponding one of the plurality of rocker arms;

each of the plurality of electromagnetic latch assemblies comprises a corresponding one of the plurality of electromagnets;

each of the plurality of electromagnets is mounted to a corresponding one of the plurality of rocker arms; and the electrical connection is one of a plurality of corresponding electrical connections from the wiring harness to each of the plurality of electromagnets.

6. The method of claim 1, wherein the module comprises a connector joining the hydraulic lash adjuster to the rocker arm assembly.

7. The method of claim 6, wherein the method further comprises removing the connector after installing the module on the cylinder head.

8. The method of claim 6, wherein the method further comprises breaking the connector joining the hydraulic lash adjuster to the rocker arm after installing the module on the cylinder head.

9. The method of claim 1, wherein:

the electromagnetic latch assembly further comprises a permanent magnet; and the permanent magnet is mounted to the rocker arm.

10. The method of claim 1, wherein a ground connection for the electromagnet is made through the cylinder head.

11. The method of claim 10, wherein the ground connection for the electromagnet is made through the hydraulic lash adjuster.

12. A valvetrain for an internal combustion engine of a type that includes a cylinder head, a poppet valve having a seat within the cylinder head, a cam shaft on which is mounted an eccentrically shaped cam, the valvetrain comprising:

an electromagnetic latch assembly comprising a latch pin translatable between a first position and a second position;

a rocker arm assembly that abuts the poppet valve and includes a cam follower and a rocker arm; and a hydraulic lash adjuster providing a fulcrum for the rocker arm;

wherein the electromagnetic latch assembly further comprises an electromagnet mounted to the rocker arm;

the rocker arm comprises a spring post, a valve end, and a second end distal from the valve end; and a slot entering the spring post is formed in one of the valve end and the second end of the rocker arm.

13. A valvetrain for an internal combustion engine of a type that includes a cylinder head, a poppet valve having a seat within the cylinder head, a cam shaft on which is mounted an eccentrically shaped cam, the valvetrain comprising:

an electromagnetic latch assembly comprising a latch pin translatable between a first position and a second position;

a rocker arm assembly that abuts the poppet valve and includes a cam follower and a rocker arm; and a hydraulic lash adjuster providing a fulcrum for the rocker arm;

wherein the electromagnetic latch assembly further comprises an electromagnet mounted within a chamber formed by the rocker arm; and an electrical connection for the electromagnet is formed by one of a spring extending toward the rocker arm, a wire trace formed on the spring, and a wire bound to the spring.

14. The valvetrain of claim 13, wherein:

the electromagnetic latch assembly further comprises a permanent magnet;

the permanent magnet is within the chamber both when the latch pin is in the first position and when the latch pin is in the second position.

15. The valvetrain of claim 13, wherein:

one of the first and second latch pin positions provides a configuration in which the rocker arm assembly is operative to actuate the poppet valve in response to rotation of the cam shaft to produce a first valve lift profile; and the other of the first and second latch pin positions provides a configuration in which the rocker arm assembly is operative to actuate the poppet valve in response to rotation of the cam shaft to produce a second valve lift profile, which is distinct from the first valve lift profile, or the poppet valve is deactivated.

16. The valvetrain of claim 13, wherein the electromagnetic latch assembly provides the latch pin with positional stability independently from the electromagnet when the latch pin is in the first position and when the latch pin is in the second position.

17. The valvetrain of claim 13, wherein:

the electromagnetic latch assembly further comprises a permanent magnet;

with the latch pin in the first position, the electromagnetic latch assembly forms a first magnetic circuit and the permanent magnet is operative to stabilize the latch pin in the first position through magnetic flux that follows the first magnetic circuit when magnetic fields from the electromagnet are absent; and with the latch pin in the second position, the electromagnetic latch assembly forms a second magnetic circuit and the permanent magnet is operative to stabilize the latch pin in the second position through magnetic flux that follows the second magnetic circuit when magnetic fields from the electromagnet are absent.

18. The valvetrain of claim 17, wherein:

the electromagnet has coils that encircle a volume within which a portion of the latch pin comprising low coercivity ferromagnetic material translates;

the electromagnetic latch assembly comprises one or more sections of low coercivity ferromagnetic material outside the coils;

both the first and the second magnetic circuits include the portion of the latch pin formed of low coercivity ferromagnetic material;

the second magnetic circuit passes around the coils via the one or more sections of low coercivity ferromagnetic material; and the first magnetic circuit does not pass around the coils.

19. The valvetrain of claim 13, wherein the electromagnet is grounded to the cylinder head.

20. The valvetrain of claim 13, wherein a ground connection for the electromagnet is made through the hydraulic lash adjuster.

* * * * *